US005522656A

United States Patent [19]

Jenkins

[11] Patent Number: 5,522,656

[45] Date of Patent: Jun. 4, 1996

[54] REFRIGERATOR DOOR CLOSURE SYSTEM

[75] Inventor: Thomas E. Jenkins, Louisville, Ky.

[73] Assignee: General Electric Company, Louisville, Ky.

[21] Appl. No.: 407,860

[22] Filed: Mar. 21, 1995

[51] Int. Cl.[6] ..... E05B 65/10

[52] U.S. Cl. ..... 292/79; 126/194; 16/344; 49/286; 312/405; 312/319.2

[58] Field of Search ..... 312/405, 319.2; 292/79, 340, 75; 49/386; 16/303, 344, 289, 297; 126/191, 194

[56] References Cited

U.S. PATENT DOCUMENTS

| | | | |
|---|---|---|---|
| 1,831,800 | 5/1930 | Bales et al. . | |
| 2,392,689 | 1/1946 | Peglow . | |
| 2,611,922 | 9/1952 | Borman et al. . | |
| 2,800,128 | 7/1957 | Chesser | 126/191 |
| 3,722,937 | 3/1973 | Stoeckl . | |
| 4,096,602 | 6/1978 | Nelson | 126/194 |
| 4,817,240 | 4/1989 | Sovis, Jr. et al. | 16/344 |
| 5,027,473 | 7/1991 | Hottmann . | |
| 5,220,747 | 6/1993 | Cherry et al. . | |

*Primary Examiner*—James R. Brittain
*Assistant Examiner*—Gerald A. Anderson
*Attorney, Agent, or Firm*—H. Neil Houser

[57] ABSTRACT

A mechanism for providing a biasing force in the desired directions at appropriate degrees of refrigerator door opening. An cam mounted to the door has a lateral wall with three interconnected linear sections joined with predetermined included angles. An arm is pivotally mounted in an aligned slot in the refrigerator housing and is spring biased into engagement with the cam. The arm and cam are arranged so that the arm exerts a strong door closing bias on the first cam section when the door is closed, exerts a greater door closing bias on the second section when the door is partially open and exerts a slight door opening bias on the third section when the door is more fully open.

8 Claims, 3 Drawing Sheets

Fig. 1
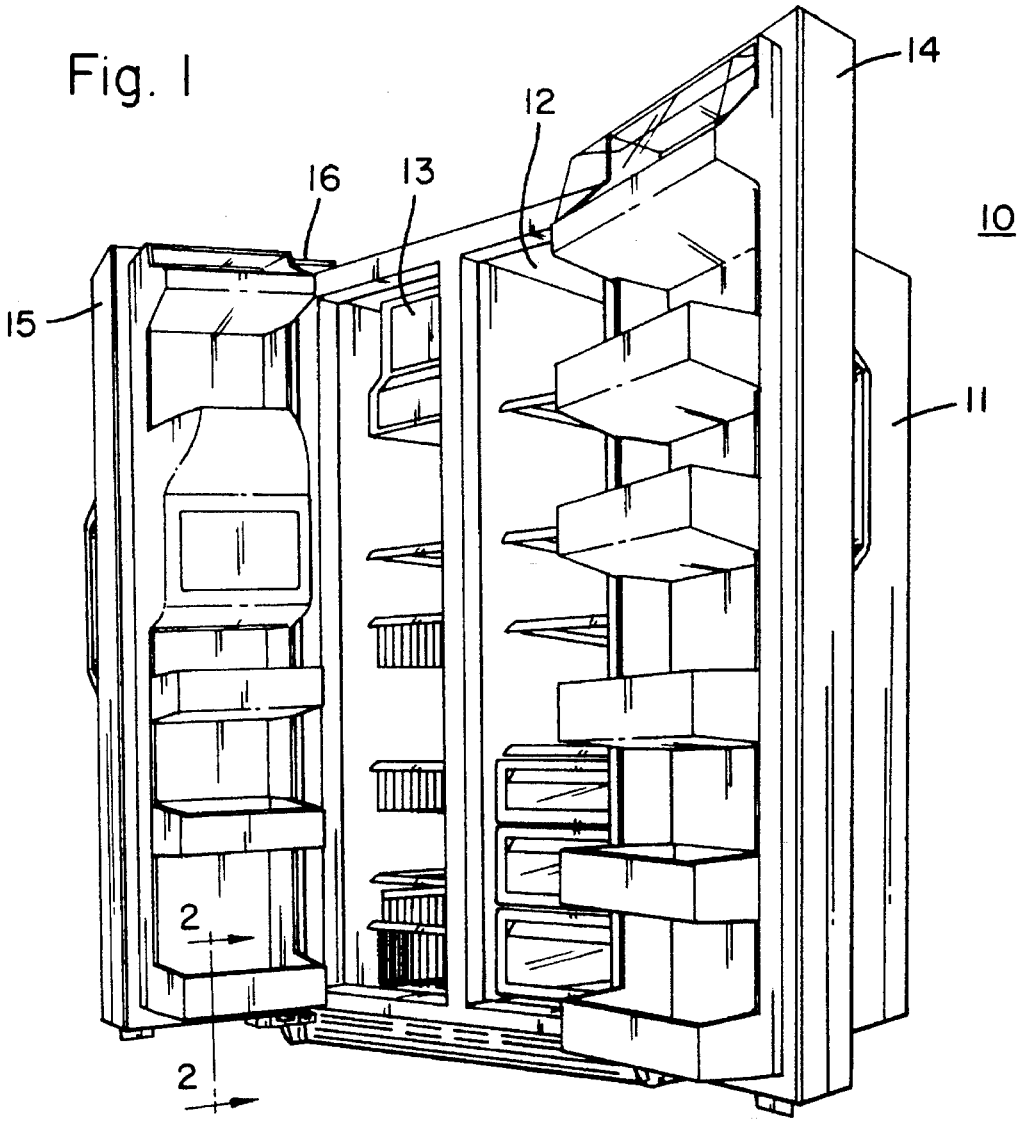
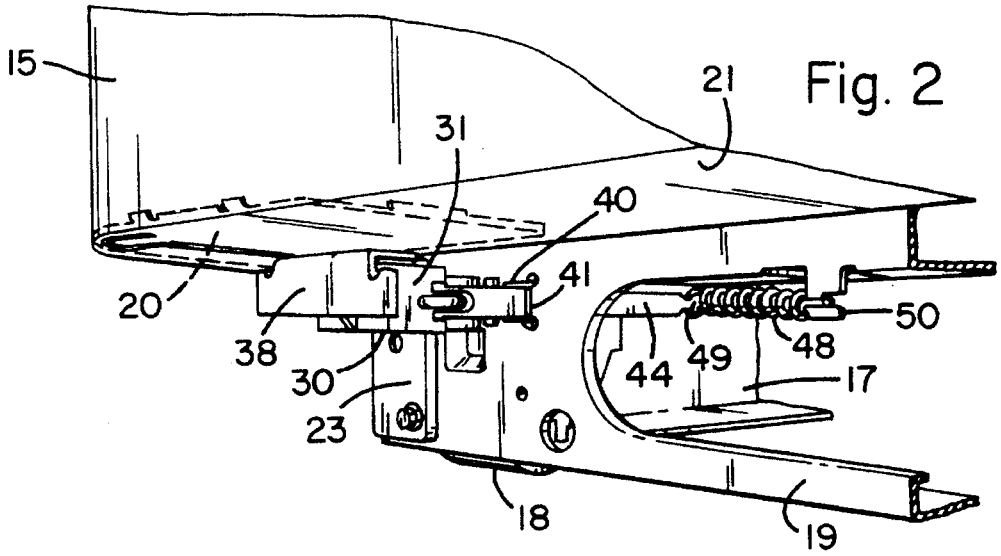
Fig. 2

REFRIGERATOR DOOR CLOSURE SYSTEM

BACKGROUND OF THE INVENTION

The present invention relates to household refrigerators and, more particularly, to an improved door biasing mechanism for such refrigerators.

It is desirable that the doors of household refrigerators have a number of distinct operating characteristics; particularly both the fresh food and freezer doors of side-side refrigerators, which are rather large. First, it is desirable that the door be biased toward its closed position with a fairly large force when the door is closed. This assures that the gasket is sufficiently compressed to provide a proper seal. Secondly, when the door is in a predetermined partially open orientation it is desirable that the door be biased toward its closed position with a force great enough to assure that it closes properly against the resistance of the gasket and the air being compressed by the door closing movement, even though the user may not exert a good closing force on the door. When the door is in a more fully open orientation beyond the partially open orientation, it is desirable that a slight bias toward the door open position be applied to the door to prevent the door accidentally closing.

The mechanism for applying such varying biasing forces on the door needs to be compact in structure so as not to interfere with other components or sub-assemblies, such as the refrigerator support mechanism and condenser. Also it should be unobtrusive when the door is both open and closed. Additionally, many side-by side refrigerators include ice and/or water dispensers in the freezer door and it is very advantageous to extend the power lines and water supply tube to the door through the door hinge. Thus the door biasing mechanism should not interfere with these items.

SUMMARY OF THE INVENTION

It is an object of this invention to provide a household refrigerator with an improved door biasing mechanism.

In accordance with one form of the invention a rail extends across the refrigerator cabinet adjacent bottom of the door. A slot in the rail includes a lateral edge and an elongated arm extends through the slot and pivots about the lateral edge. A cam member mounted to the adjacent end of the door includes a lateral wall having first, second and third linear sections. The first and second sections meet with a first obtuse included angle while the second and third sections meet with second obtuse angle, smaller than the first angle. A follower mounted on the outer end of the arm engages the cam lateral wall and a spring connects the inner end of the arm to the rail to bias the arm into engagement with the lateral wall. The spring, arm and cam are arranged such that the follower engages the first wall section when the door is in its closed position and exerts a strong bias on the cam member opposing opening movement of the door; the follower engages the second wall section when the door is in a partially open orientation and thereupon exerts a strong door closing bias on the cam; and the follower engages the third wall section when the door is in a more fully open orientation and thereupon exerts a slight bias on the cam opposing door closing.

BRIEF DESCRIPTION OF THE DRAWINGS

FIG. 1 is a front perspective view of a household refrigerator incorporating one embodiment of the present invention, with the doors open for illustration.

FIG. 2 is a fragmentary view of the lower left front corner of the refrigerator of FIG. 1 generally as seen along line 2—2 in FIG. 1, illustrating certain aspects of the invention.

DETAILED DESCRIPTION OF PREFERRED EMBODIMENT

Figure 4:
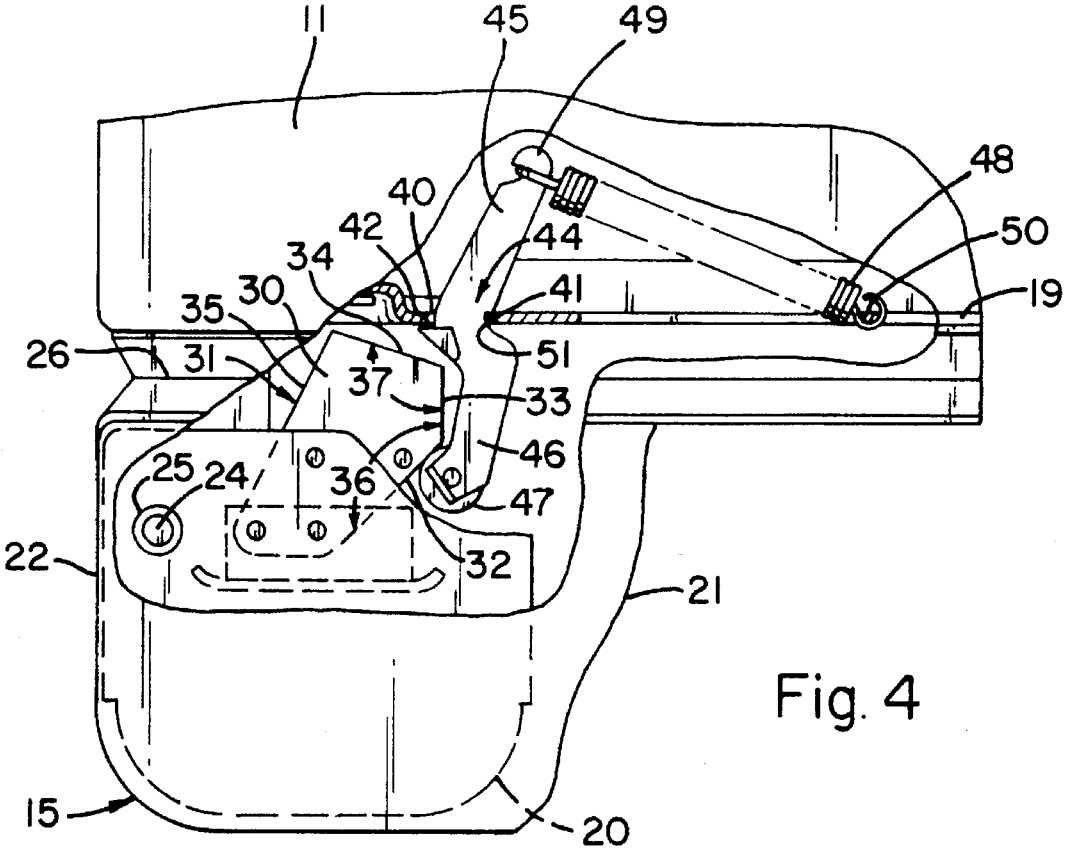
FIG. 4 is a simplified plan view of the front left corner of the refrigerator of FIG. 1, the view being partly broken away and illustrating the biasing mechanism with the door in its closed position.

Referring now to FIG. 1, there is shown, in simplified form, a refrigerator 10 including a cabinet 11 defining a fresh food compartment 12 and a freezer compartment 13 in a side-by-side orientation. Access to the compartments 12,13 is provided by a fresh food door 14 and a freezer door 15 respectively. Each of the doors 14,15 is mounted by hinges, such as 16, for pivotal movement about a vertical axis positioned adjacent its outer edge.

Box like channel members 17, see FIG. 2, are attached to and extend front to rear along the lateral edges of the underside of the cabinet 11. Each channel member 17 supports wheels 18 which support the refrigerator on the floor and a mechanism, not shown, for leveling the cabinet to compensate for any irregularity in the floor.

A support member or front rail 19 extends across the lower front edge of the cabinet 11. The rail 19 is attached to and forms an integral part of the cabinet. The rail is formed from a heavy metal to provide rigidity to the front of the cabinet and a stable mount for the doors 14,15.

Figure 3:
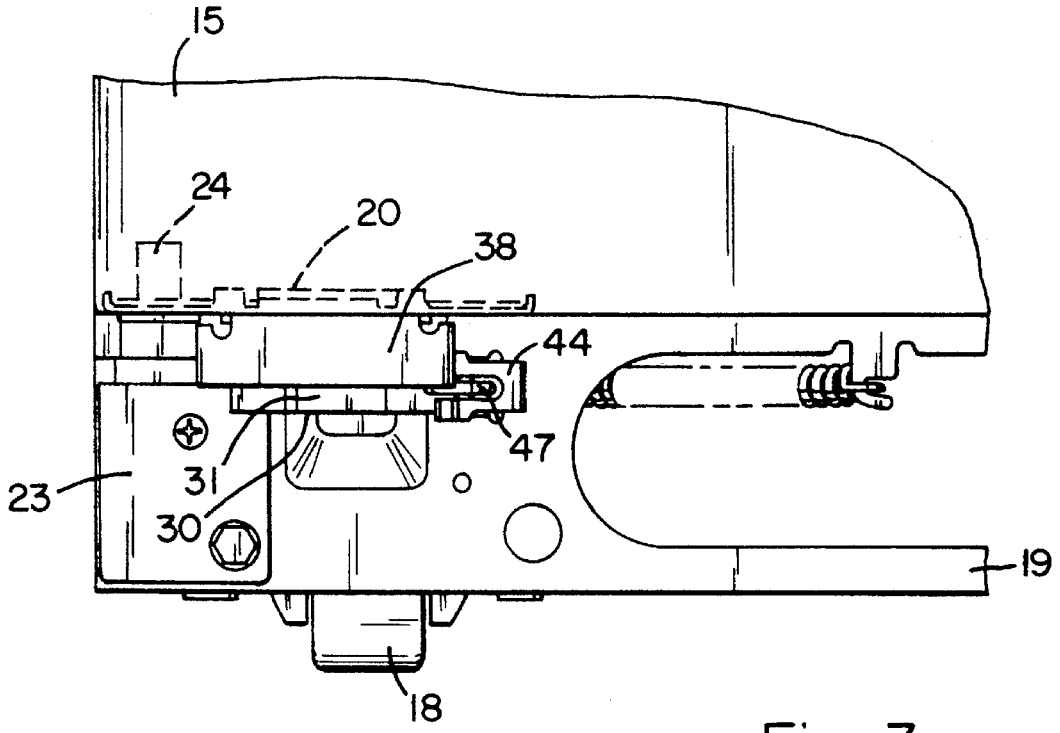
FIG. 3 is a fragmentary front elevation view of the lower left front corner of the refrigerator of FIG. 1

Referring now to FIGS. 2 and 3, the freezer door 15 conveniently is formed from a folded sheet of thin metal and is filled with a suitable insulation. A reinforcing plate 20 is attached to the lower end or wall 21 of the door 15 adjacent its outer edge or wall 22. An L-shaped hinge plate 23 is mounted on the rail 19 in alignment with the reinforcing plate 20. The door 15, reinforcing plate 21 and hinge plate 23 have aligned openings which receive a hinge pin 24 in a low friction washer 25. A similar hinge arrangement is provided at the top of door 15 and at both the top and bottom of door 14. As each door is opened and closed it pivots about the substantially vertical axis defined by the hinges at its top and bottom corners. As is well known in the art, the hinge pin 24 at the bottom of the freezer can be hollow for the passage of electric wiring and a water tube (not shown). If desired the bottom pin of the fresh food door 14 also can be hollow for similar purposes.

While the biasing mechanism for the left hand door 15 will be described, it will be understood that a mirror image mechanism conveniently will be used on the right hand door. It also will be understood that side-by-side refrigerators can have the freezer on either the left hand or the right hand side of the fresh food compartment. The biasing mechanism of the present invention is equally useful with both freezer and fresh food doors of either orientation, as well as with doors of top mount refrigerators, in which the freezer is above the fresh food compartment.

Referring now particularly to FIGS. 3–6 the biasing mechanism for door 15 is located at the lower, outer or pivot corner of the door. The mechanism includes a cam member 30 mounted on the outside of lower wall 21 of the door and spaced inwardly of the hinge pin 24. Conveniently the cam 30 is mounted to the reinforcing member 20. The cam 30 has a lateral wall 31 with first, second and linear sections 32, 33 and 34 respectively. The first and second sections 32,33 meet with a first included obtuse angle or corner 36 while the second and third sections 33,34 meet with a second included obtuse angle or corner 37, which is smaller than first angle 36. The cam 30 is mounted to protrude toward the cabinet from the door. In the illustrative embodiment the corner or junction between third wall section 34 and a fourth wall section 35 is spaced slightly in front of the rail 19 when the door 15 is in its closed orientation (see FIG. 4). An L-shaped stop 38 is attached to the underside of wall 21 outside the cam 30. When the door reaches its maximum open position the stop engages hinge plate 23.

The rail 19 includes a slot 40 having a pair of opposed lateral edges 41, 42 at its ends. An elongated arm 44 is mounted to extend through the slot 40 with its inner end 45 inside the rail and its outer end 46 outside the rail and adjacent the cam 30. The outer end 46 carries a roller 47 positioned to engage the lateral wall 31. A tension spring 48 has one end connected to a hook 49 formed at the inner end of arm 44 and its other end connected to a hook 50 formed in the rail 19. The spring 48 urges the roller 47 into engagement with cam 30 for exerting desired biasing forces or torques on the cam and thus on the door. To that end the side of the intermediate portion of the arm 44 toward the spring 48 is formed as a detent or notch 51 which engages the lateral edge 41 of rail 19. This engagement acts as a pivot point for the arm 44. The opposite side of arm 44 is formed with a nose 52 that overlaps the other lateral edge 42 of rail 19.

Viewing now particularly FIG. 4, the fully closed position of door 15 is shown in solid line. In this door position a gasket 26 carried by door 15 engages the front of cabinet 11 and seals the junction between the door and cabinet. The roller 47 engages the first cam section 32 adjacent its junction with section 33 and the spring is in a highly stressed state. When the door is opened the cam moves away from the rail. Initially the roller 47 moves around the corner or angle 36 from section 32 to section 33, the position shown in dashed line in FIG. 5. This initial movement causes the spring 48 to be stretched and the spring and arm 44 cause the roller to exert a strong force or torque on the cam 30 opposing the initial opening movement of the door. In the illustrative embodiment the torque or force opposing initial door opening is about twenty-five inch pounds.

Figure 5:
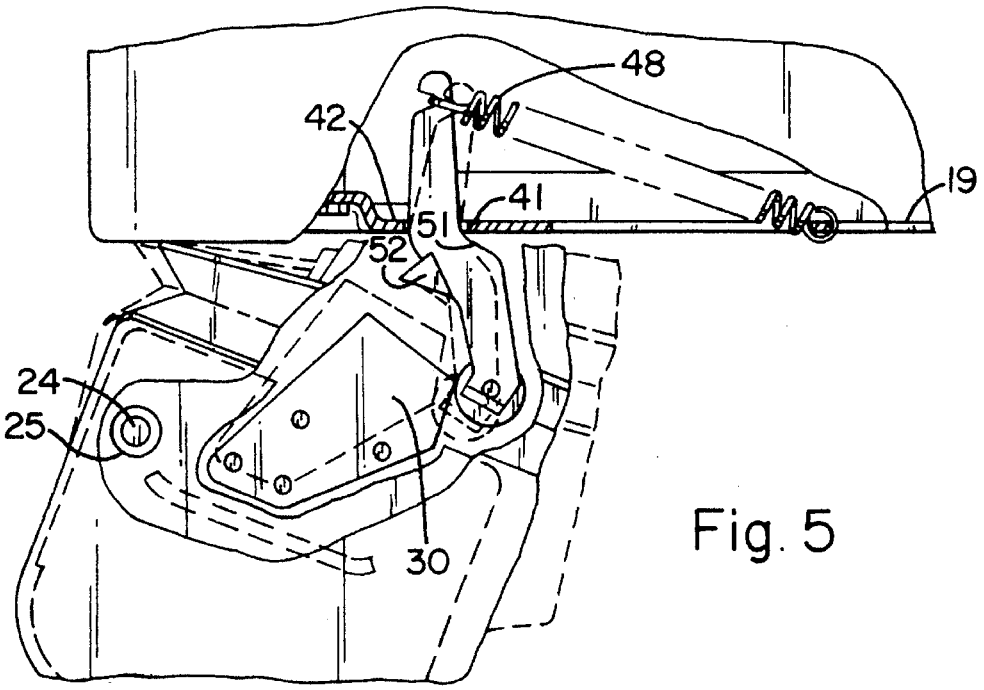
FIG. 5 is a plan view similar to FIG. 4, but illustrating the biasing mechanism with the door in its partially open orientation.

In the illustrative embodiment the roller has moved to the dashed line position of FIG. 5 when the door is opened to a first partially open, or ajar, position of about five degrees. As the door is opened further the cam wall section 33 pivots clockwise (as seen in FIG. 5) causing the roller 47 to move along the section 33 until it reaches the end of section 33 adjacent the angle or corner 37, which position is shown in solid line in FIG. 5. At this point the door 15 has reached a second partially open position which, in the illustrative embodiment is about twenty-six degrees. As the door moves from its first partially open (ajar) position to its second partially open position the cam 30 forces the arm 44 to pivot in a counter clockwise direction (as seen in FIG. 5). This stretches the spring 48 so that the spring exerts a biasing force or torque on the door which, in the illustrative embodiment is about twenty-nine inch pounds. In other words, when the door is in a partially open orientation or configuration, between its first partially open (ajar) position and its second partially open position, The spring and arm exert a strong biasing force or torque on the cam and door in the door closing direction.

Figure 6:
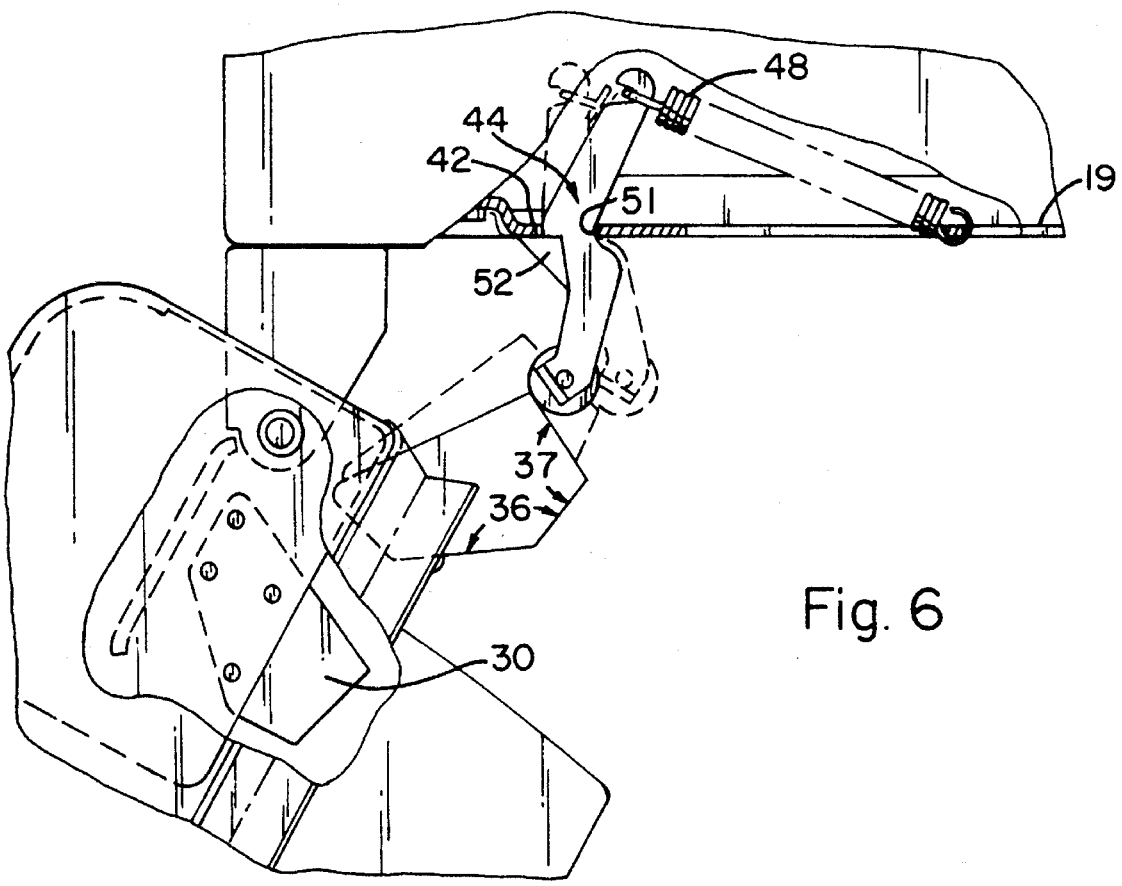
FIG. 6 is a plan view similar to FIG. 4 but showing the biasing mechanism with the door in its more fully open position and beyond.

As the door is opened further the roller immediately moves around the angle 37 from the second wall section 33 to third wall section 34, that is from the position shown in solid line in FIG. 5 to the position shown in dashed line in FIG. 6. Further opening of the door causes the roller to move along the section 34 to its opposite end, as shown in solid line in FIG. 6. When roller 47 is at the end of section 34 remote from section 33 the door has reached a more fully open position which, in the illustrative embodiment, is about forty-six degrees. As the door moves from its second partially open position to its more fully open position the arm 44 pivots in a clockwise direction (as seen in FIG. 6) allowing the spring to contract or relax. In other words, when the door is in this more open orientation than its second partially open position and the roller engages wall section 34, the spring and arm exert a slight torque or force on the cam and door in the door opening direction. In the illustrative embodiment this slight torque is about two inch pounds.

When the door 15 is in its more fully open position, illustrated by the solid line engagement of cam 30 and roller 47 in FIG. 6, the nose 52 of arm 44 engages the lateral edge 42 of rail 19. If the door is opened further, the cam 30 will disengage from the roller 47. However, the spring 48 and the engagement between nose 52 and edge 42 maintain the arm 44 in the solid line position shown in FIG. 6. The door is free to further pivot open to the position shown by the door in FIG. 6. At that point the stop 38 engages the hinge plate 23.

Assuming the user opens the door beyond its second partially open position, shown in dashed line engagement of cam section 34 and roller 47 in FIG. 6 and then releases the door in order to insert or remove items form the freezer, the biasing mechanism exerts a slight force of the door in a door opening direction. This will maintain the door open and, assuming the refrigerator is substantially level, will cause the door to assume the more fully open position of about forty-six degrees shown by the solid line engagement of cam section 34 and roller 47 in FIG. 6.

When the door is in its more fully open orientation, with roller 47 engaging wall section 34, the door is stable yet the user need exert only a slight force or torque to move the door to the second partially open position shown in solid line in FIG. 5. Once the door reaches the second partially open position, the biasing mechanism exerts a strong torque or force on the door in the door closing direction. This assures that the door will completely close, even though the user's hands are full and she/he cannot apply a very effective closing action.

When the door reaches its fully closed position shown in FIG. 4 the biasing mechanism exerts a strong torque or force on the door opposing opening movement of the door. This assures that, when the door closes, it will not rebound to a partially open or ajar position. It also assures that the door will stay fully closed with the gasket 26 effectively engaging the cabinet 11 around the edge of the door 15.

It will be noted that the biasing mechanism, including the cam 30, arm 44 and spring 48 are positioned well to the side of the roller 18 and the hinge pin 24. This assures that the biasing mechanism will not interfere with either of these other mechanisms and that there is sufficient room to run wires and a water tube to the door hinge. In addition the parts of the biasing mechanism inside the rail 19 is located close to the rail. This assures that the mechanism will not interfere with the refrigeration system that often is located in the lower rear portion of the cabinet 11.

While a specific embodiment of the invention has been illustrated and described herein, it is realized that modifications and changes will occur to those skilled in the art to which the invention pertains. It is therefore to be understood that the appended claims are intended to cover all such modifications and changes as fall within the true spirit and scope of the invention.

What is claimed is:

1. A household refrigerator including a cabinet defining a refrigerated space; a door for selectively closing said refrigerated space; hinges mounting said door for pivotal movement between open and closed positions relative to said cabinet, said door having a closed position, a partially open orientation and a more fully open orientation; and a door biasing mechanism including:

a rail extending across said cabinet adjacent one end of said door; said rail including a slot therein having a first lateral edge;

an elongated arm extending through said slot and having one end inside said cabinet, an outer end outside said cabinet and an intermediate portion pivoted about said first lateral edge of said slot;

a cam member mounted to said door and including a lateral wall aligned with said outer end of said arm, said lateral wall including first, second and third interconnected linear sections; said first and second sections meeting with a first included obtuse angle and said second and third sections meeting with a second included obtuse angle less than said first angle;

a follower mounted to said outer end of said arm for engagement with said lateral wall; and a spring connecting said arm to said cabinet and biasing said follower into engagement with said lateral wall;

said follower engaging said first linear section when said door is in the closed position and said spring causing said arm to exert a strong bias on said cam opposing opening movement of said door;

said follower engaging said second linear section when said door is in the partially open orientation and said spring thereupon causing said arm to exert a strong door closing bias on said cam;

said follower engaging said third linear section when said door is in the more fully open orientation and said spring thereupon causing said arm to exert a slight bias on said cam opposing door closing.

2. A refrigerator as set forth in claim 1, wherein: said intermediate portion of said arm being formed as a detent which receives said first lateral edge of said slot.

3. A refrigerator as set forth in claim 1, wherein:

said door is pivotal in a door open direction beyond the more fully open orientation;

said slot has a second edge opposite the first edge; and a nose projects outward of said intermediate portion of said arm opposite said detent;

said nose engaging said rail adjacent said second lateral edge when said door pivots open beyond the more fully open orientation.

4. A refrigerator as set forth in claim 1, wherein:

said cam member is mounted to said one end of said door at a location out of interference with the hinge associated with that end of said door.

5. A refrigerator as set forth in claim 1, wherein:

said follower is a roller mounted to said outer end of said arm.

6. A refrigerator as set forth in claim 1, wherein:

said arm is pivoted on said rail to a side of said cam opposite the adjacent door mounting hinge.

7. A refrigerator as set forth in claim 6, wherein:

said spring is attached to said rail at a position further from said adjacent door hinge than said slot.

8. A refrigerator as set forth in claim 1, wherein:

said cam is mounted to an outside surface of said one end of said door and projects beyond said door toward said rail;

said cam being slightly spaced from said rail when said door is in the closed position.

* * * * *